US009774959B2

(12) United States Patent
Kupershmidt

(10) Patent No.: US 9,774,959 B2
(45) Date of Patent: Sep. 26, 2017

(54) PICO-SPEAKER ACOUSTIC MODULATOR

(71) Applicant: DSP Group LTD., Herzeliya (IL)

(72) Inventor: Haim Kupershmidt, Or Yehuda (IL)

(73) Assignee: DSP GROUP LTD., Herzliya (IL)

( * ) Notice: Subject to any disclaimer, the term of this patent is extended or adjusted under 35 U.S.C. 154(b) by 0 days.

(21) Appl. No.: 15/075,246

(22) Filed: Mar. 21, 2016

(65) Prior Publication Data

US 2016/0286319 A1 Sep. 29, 2016

Related U.S. Application Data

(60) Provisional application No. 62/137,835, filed on Mar. 25, 2015.

(51) Int. Cl.
*H04R 19/02* (2006.01)
*H04R 17/00* (2006.01)

(52) U.S. Cl.
CPC ..... *H04R 19/02* (2013.01); *H04R 17/00* (2013.01); *H04R 2201/003* (2013.01); *H04R 2217/03* (2013.01)

(58) Field of Classification Search
CPC ..... H04R 17/02; H04R 19/04; H04R 1/00; H04R 2205/022; H04R 2201/401; H04R 2201/405; H04R 19/005
USPC ..... 381/173–175, 182, 186, 369
See application file for complete search history.

(56) References Cited

U.S. PATENT DOCUMENTS 4,211,898 A * 7/1980 Atoji ..... H04R 9/047 381/349
8,861,752 B2 * 10/2014 Margalit ..... H04R 1/22 381/152
2016/0345104 A1 * 11/2016 Margalit ..... H04R 1/24
2016/0381464 A1 * 12/2016 Elyada ..... H04R 19/02 381/97

* cited by examiner

*Primary Examiner* — Suhan Ni
(74) *Attorney, Agent, or Firm* — Reches Patents

(57) ABSTRACT

A MEMS speaker that may include a membrane positioned in a first plane, wherein the membrane may be configured to oscillate at a first frequency thereby generating an ultrasonic acoustic signal; and an acoustic modulator that may include a blind and a shutter; wherein the blind may be positioned in a second plane; wherein the shutter may be positioned in a third plane; wherein the first plane, the second plane and the third plane may be substantially separated from each other; and wherein the acoustic modulator may be configured to (a) receive or generate a shutter control signal and a blind control signal, and (b) modulate, in response to the shutter control signal and the blind control signal, the ultrasonic acoustic signal such that an audio signal may be generated.

22 Claims, 10 Drawing Sheets

800

900

1000

PICO-SPEAKER ACOUSTIC MODULATOR

CROSS REFERENCE TO RELATED APPLICATIONS

This application claims the priority of U.S. provisional patent Ser. No. 62/137,835, filing date Mar. 25, 2015 which is incorporated herein by reference.

BACKGROUND OF THE DISCLOSURE

Field of the Disclosure

This disclosure relates to techniques for generating an audio signal on mobile devices using a MEMS speaker.

Background to the Disclosure

A speaker is a device that generates acoustic signals. A traditional speaker usually includes a moving membrane actuated (e.g. using electromagnetic actuation) by a signal in the Audio frequencies, representing the actual Audio signal that needs to be rendered by a speaker. The moving membrane then creates a local change in air pressure that is related to the audio signal. As a result of these local changes in air pressure, an acoustic wave is generated and propagated through the air, thus reproducing the Audio signal used to actuate the membrane. For a given displacement d of a membrane of diameter D, the sound pressure of the wave generated scales with the frequency f as $(Ddf)^2$.

Thus, the Sound Pressure Level (SPL) of such a speaker is decreased with frequency at a rate of 40 dB for drop in frequency by factor 10. Because of such scaling, a traditional speaker requires a large diaphragm in order to produce low frequency sounds. This fundamental principle is a limitation on the design of small sized speakers, used in mobile devices, for example.

One design of small speakers for use in mobile devices is known as a micro-electro-mechanical system pico-speaker or "MEMS pico-speaker" and is described in the U.S. Pat. No. 8,861,752. The same scaling of sound pressure increasing with frequency to a power of two is used in the pico-speaker. As described in U.S. Pat. No. 8,861,752, a membrane is oscillated at an ultrasonic frequency that is modulated with the wanted audio signal. An acoustic shutter is then used to obstruct and open the air flow of the ultrasonic wave generated by the oscillating membrane, thus modulating this ultrasonic wave. Operating the shutter/modulator at ultrasonic frequency identical to the central frequency used for the membrane results in generating output air pressure in audio frequencies range, corresponding to the wanted audio signal.

SUMMARY

According to an embodiment of the invention there may be provided a MEMS speaker that may include a membrane positioned in a first plane, wherein the membrane may be configured to oscillate at a first frequency thereby generating an ultrasonic acoustic signal; and an acoustic modulator that may include a blind (an apertured sheet) and a shutter; wherein the blind may be positioned in a second plane; wherein the shutter may be positioned in a third plane; wherein the first plane, the second plane and the third plane may be substantially separated from each other; and wherein the acoustic modulator may be configured to (a) receive or generate a shutter control signal and a blind control signal, and (b) modulate, in response to the shutter control signal and the blind control signal, the ultrasonic acoustic signal such that an audio signal may be generated.

The shutter control signal and the blind control signal may be phase shifted in relation to each other.

The shutter control signal and the blind control signal may be in anti-phase.

The blind may be flexible.

The blind and the shutter may be configured to oscillate between a first position in which the blind seals shutter openings and between a second position in which the blind does not seal shutter openings.

The blind and the shutter may be configured to oscillate between a first position in which the acoustic modulator attenuates the ultrasonic acoustic signal by a first attenuation factor and between a second position in which in which the acoustic modulator attenuates the ultrasonic acoustic signal by a second attenuation factor that differs from the first attenuation factor.

The ratio between the first attenuation factor and the second attenuation factor may range between 5 db and 10 db or may have any other value.

The shutter and the blind may be configured to oscillate at an oscillating frequency; wherein the oscillating frequency substantially equals a resonant frequency of the shutter and substantially equals a resonant frequency of the blind.

When the MEMS speaker is idle the vertical projections of shutter openings on the blind do not overlap blind openings. The shutter control signal and blind control signal once provided to the shutter and the blind may generate an alternating electrostatic force between the shutter and the blind.

Each one of the shutter and the blind may include a piezoelectric layer that may be positioned between a pair of electrodes.

The membrane may be fed with a membrane control signal that may be of ultrasonic frequency and may be modulated by an input audio signal; wherein the shutter control signal and the blind control signal may be of ultrasonic frequency and may not be modulated by the input audio signal.

According to an embodiment of the invention there may be provided a device that may include an array of substantially identical cells; wherein each cell may include a membrane, a blind and a shutter; wherein multiple membranes of the multiple cells may be positioned in a first layer; wherein multiple blinds of the multiple cells may be positioned in a second layer; wherein multiple shutters of the multiple cells may be positioned in a third layer; wherein the first plane, the second plane and the third plane may be substantially separated from each other; wherein a given MEMS cell of the cell array may include a given membrane that may be configured to oscillate at a first frequency thereby generating a given ultrasonic acoustic signal; a given blind and a given shutter of the given MEMS cell form a given acoustic modulator that may be configured to (a) receive a given shutter control signal and a given blind control signal, and (b) modulate, in response to the given shutter control signal and the given blind control signal, the given ultrasonic acoustic signal such that a given audio signal may be generated.

According to an embodiment of the invention there may be provided a MEMS speaker that may include a membrane positioned in a first plane, wherein the membrane may be configured to oscillate at a first frequency thereby generating an ultrasonic acoustic signal; and an acoustic modulator that may include a blind and a shutter; wherein the blind may be positioned in a second plane; wherein the shutter may be positioned in a third plane; wherein the first plane, the second plane and the third plane may be substantially separated from each other; wherein the acoustic modulator may be configured to modulate the ultrasonic acoustic signal, by oscillating both the blind and the shutter, to provide an audio signal.

The acoustic modulator may be configured to apply an alternating electrostatic force between the shutter and the blind.

The acoustic modulator may be configured to apply a piezo-electric actuation on the shutter and the blind.

According to an embodiment of the invention there may be provided a method for operating a MEMS speaker. The MEMS speaker may include a membrane positioned in a first plane, wherein the membrane may be configured to oscillate at a first frequency thereby generating an ultrasonic acoustic signal; and an acoustic modulator that may include a blind and a shutter; wherein the blind may be positioned in a second plane; wherein the shutter may be positioned in a third plane; wherein the first plane, the second plane and the third plane may be substantially separated from each other. The method may include: (a) receiving or generating by the acoustic modulator a shutter control signal and a blind control signal, and (b) modulating, in response to the shutter control signal and the blind control signal, the ultrasonic acoustic signal such that an audio signal may be generated.

The shutter control signal and the blind control signal may be phase shifted in relation to each other.

The shutter control signal and the blind control signal may be in anti-phase.

The blind may be flexible.

The method may include oscillating the blind and the shutter between a first position in which the blind seals shutter openings and between a second position in which the blind does not seal shutter openings.

The method may include oscillating the blind and the shutter between a first position in which the acoustic modulator attenuates the ultrasonic acoustic signal by a first attenuation factor and between a second position in which in which the acoustic modulator attenuates the ultrasonic acoustic signal by a second attenuation factor that differs from the first attenuation factor.

The ratio between the first attenuation factor and the second attenuation factor may range between 5 db and 10 db or may have any other value.

The method may include oscillating the blind and the shutter at an oscillating frequency; wherein the oscillating frequency substantially equals a resonant frequency of the shutter and substantially equals a resonant frequency of the blind.

When the MEMS speaker is idle the vertical projections of shutter openings on the blind do not overlap blind openings.

The method may include providing the shutter control signal and blind control signal thereby generating an alternating electrostatic force between the shutter and the blind.

Each one of the shutter and the blind may include a piezoelectric layer that may be positioned between a pair of electrodes.

The method may include feeding the membrane with a membrane control signal that may be of ultrasonic frequency and may be modulated by an input audio signal. The method may include receiving of generating the shutter control signal and the blind control signal that are of ultrasonic frequency and may be not modulated by the input audio signal.

According to an embodiment of the invention there may be provided method for operating a device that includes multiple MEMS cells. Each cell may include a membrane, a blind and a shutter; wherein multiple membranes of the multiple cells may be positioned in a first layer; wherein multiple blinds of the multiple cells may be positioned in a second layer; wherein multiple shutters of the multiple cells may be positioned in a third layer; wherein the first plane, the second plane and the third plane may be substantially separated from each other. Wherein a given cell of the multiple cells in the array may include a given membrane that may be configured to oscillate at a first frequency thereby generating a given ultrasonic acoustic signal; a given blind and a given shutter of the given cell form a given acoustic modulator.

Wherein for each given MEMS cell of the array the method may include (a) receiving a given shutter control signal and a given blind control signal, and (b) modulating, in response to the given shutter control signal and the given blind control signal, the given ultrasonic acoustic signal such that a given audio signal may be generated.

According to an embodiment of the invention there may be provided method for operating a MEMS speaker. The MEMS speaker may include (a) a membrane positioned in a first plane, wherein the membrane may be configured to oscillate at a first frequency thereby generating an ultrasonic acoustic signal; and (b) an acoustic modulator that may include a blind and a shutter; wherein the blind may be positioned in a second plane; wherein the shutter may be positioned in a third plane; wherein the first plane, the second plane and the third plane may be substantially separated from each other.

The method may include modulating the ultrasonic acoustic signal, by oscillating both the blind and the shutter, to provide an audio signal.

The method may include applying an alternating electrostatic force between the shutter and the blind.

The method may include applying a piezo-electric actuation on the shutter and the blind.

DETAILED DESCRIPTION OF THE DISCLOSURE

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

Because the illustrated embodiments of the present invention may for the most part, be implemented using MEMS components and circuits known to those skilled in the art, details will not be explained in any greater extent than that considered necessary as illustrated above, for the understanding and appreciation of the underlying concepts of the present invention and in order not to obfuscate or distract from the teachings of the present invention.

Some embodiments of the present disclosure are generally related to improvements in the acoustic modulator used in a MEMS pico speaker, but the same embodiments may be used for other purposes, wherever acoustic modulation can be of use.

Figure 1:
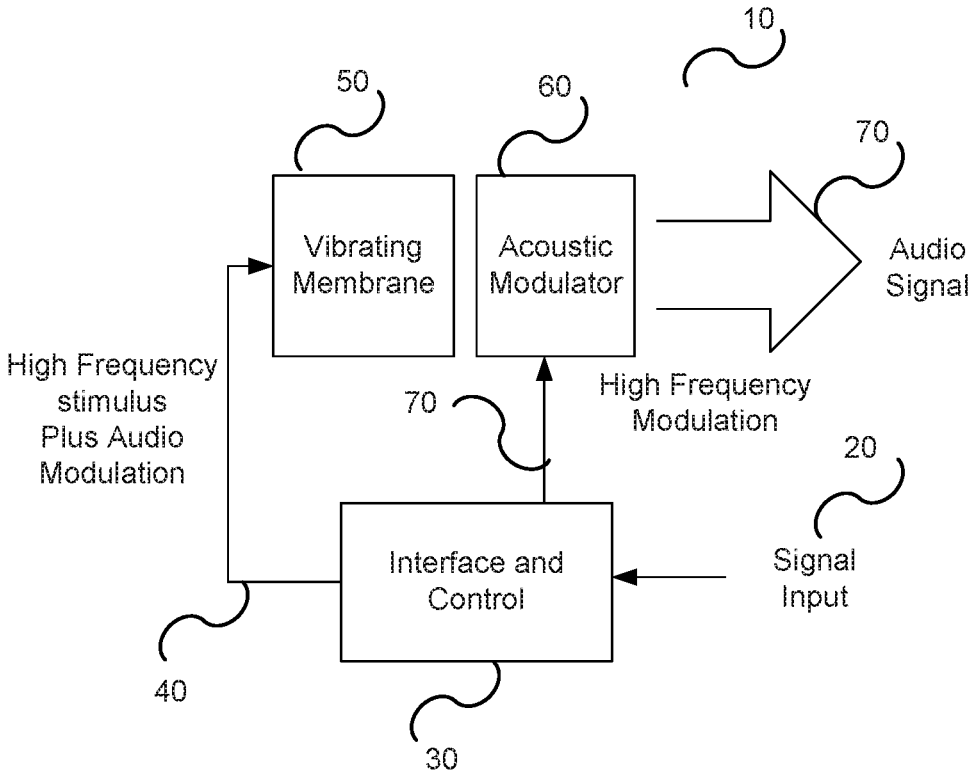
FIG. 1 is a block schematic diagram of an example pico-speaker according to an embodiment of the invention.

First consider the following review of an example pico-speaker design so that differences with the proposed method can be elucidated. FIG. 1 is a block schematic diagram of an example pico-speaker 10. The audio signal input 20 is applied to the interface and control block 30. The interface and control block 20 generates two stimulus frequency signals 40 and 70. Frequency signal 40 is at an ultra sound frequency which is modulated by the audio input signal 20. A typical ultrasound frequency may be in the 100 to 500 KHz range. Frequency signal 40 is applied to the membrane 50. This causes the membrane to oscillate or vibrate in sympathy with the stimulus frequency 40. The ultrasonic wave resulting from the membrane vibrations is modulated by the acoustic modulator block 60. The action of the acoustic modulator 60 is to obstruct and open the air flow from the membrane 50. The stimulus signal 70 from the interface and control 30 is at the same ultrasonic frequency used to stimulate the membrane 40, but in this case it is not modulated by the audio signal. It can be shown that the resulting acoustic wave 70 can be made to have a strong component at the audio signal frequencies, corresponding to the Input Signal 20.

Due to the fact that air pressure from a given membrane rises with frequency to the power of two, the performance of such a pico-speaker is such that the low frequencies and hence the overall quality of the audio performance is improved over a conventional speaker design. The interface and control block generates the actuation voltages required in order to vibrate the membrane and the shutter. These actuation voltages depend on the specific type of the actuation scheme. For example, for electrostatic actuation these are typically in the order of 100 to 120V.

Figure 2:
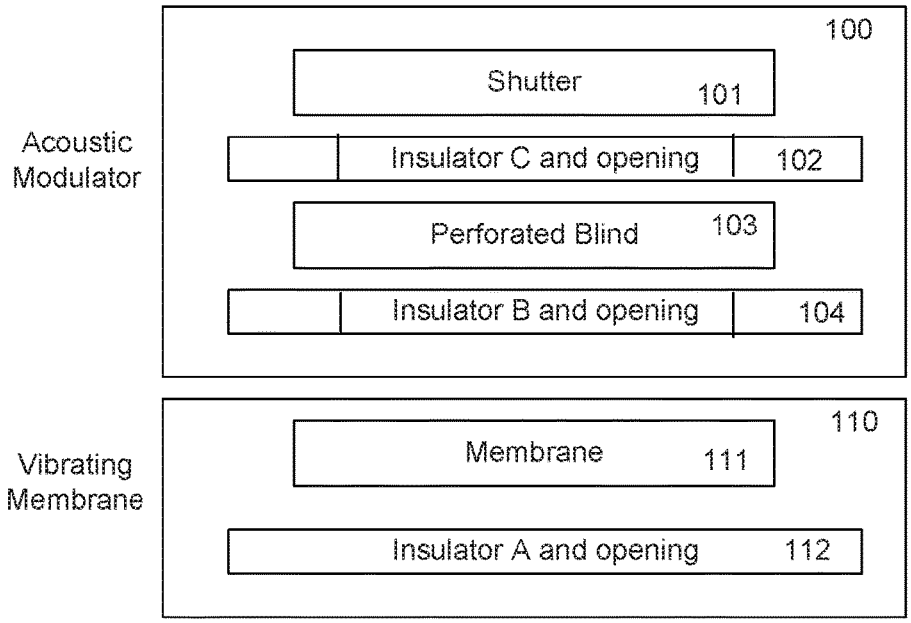
FIG. 2 is diagram of the mechanical construction of a pico-speaker as described in FIG. 1 according to an embodiment of the invention.

FIG. 2 is diagram of the mechanical construction of a pico-speaker as described in FIG. 1. The vibrating membrane 110 consists of two parts, the membrane 111 and an insulator and support structure 112, which mechanically supports the membrane and also allows the membrane to vibrate. The acoustic modulator 100 consists of four parts. Structural support 104 separates and supports the perforated blind 103. The blind 103 is a rigid but receives a separate control signal than the shutter sheet that has apertures in it to allow the flow of air resulting from the vibrating membrane. Support structure 104 separates the blind 103 from the membrane 111 so as to supports the blind 103 but also to allows room for the membrane 111 to vibrate. Support structure 102 separates the blind 103 and the shutter 101 such that the shutter 101 is supported but can still vibrate. The action is that as the shutter 101 vibrates it may selectively narrow and widen the path of air that may flow through the acoustic modulator and thus may selectively interrupt the air flow from membrane 111.

FIGS. 3A-3E are examples of MEMS pico-speaker mechanical design 250 together with example designs for the membrane 200, blind 210 and shutter 220 that are fed by a membrane control signal 530, blind control signal 570 and shutter control signal 580 respectively according to various embodiments of the invention. In this example the pico-speaker mechanical design is a small cylinder. The mechanical assembly is shown as a part cut away diagram for clarity. The speaker design consists of the membrane, blind and shutter as well as the three support structures as introduced in FIG. 2. The interface and control block, 30 as described in FIG. 1, is generally external to the mechanical speaker package.

Figure 3A:
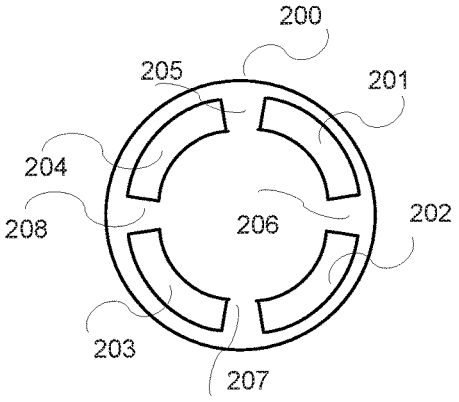
FIG. 3A is an example of the design of membrane according to an embodiment of the invention.
Figure 3B:
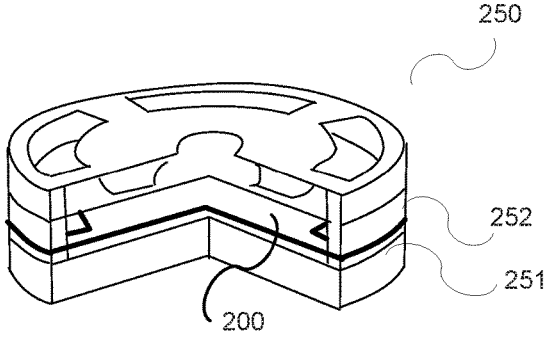
FIG. 3B is a sketch of the mechanical assembly of an example pico-speaker showing the membrane according to an embodiment of the invention.

FIG. 3A is an example of the design of membrane 200. The membrane 200 is a circular design with four symmetrical apertures 201, 202, 203 and 204 situated at the edge of the membrane, suspended on springs 205, 206, 207 and 208. The four springs with the corresponding apertures facilitate the vibration of the membrane. FIG. 3B is a sketch of the mechanical assembly of an example pico-speaker showing the structural support, 251 and above that the membrane 200. Above the membrane 200 is structural support 253. The membrane 200 is therefore sandwiched between the two structural supports 251 and 253. Structural support 251 will typically consist of a base and an outer edge support for the membrane 200. Insulator 252 will typically be a ring that supports the out edge of the membrane 200 thus allowing the membrane to vibrate freely.

Figure 3C:
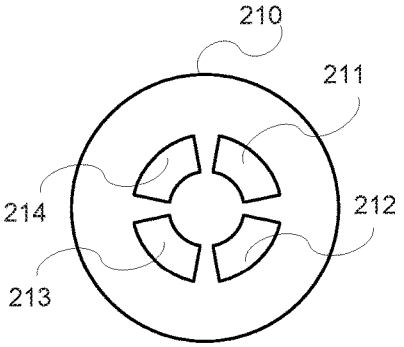
FIG. 3C is an example of the design of a blind according to an embodiment of the invention.
Figure 3D:
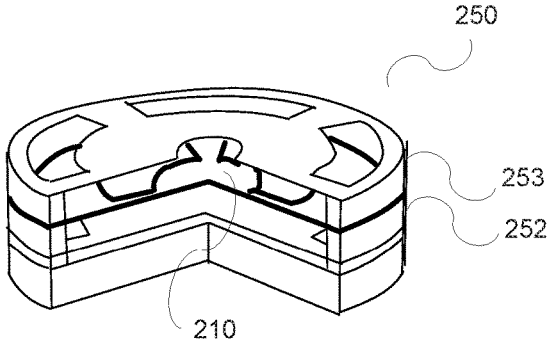
FIG. 3D is a sketch of the mechanical assembly of an example pico-speaker showing the blind according to an embodiment of the invention.

FIG. 3C is an example of the design of a blind 210. The blind 210 is a circular design with four symmetrical apertures 211, 212, 213 and 214. The four apertures are located such that the air flow from the membrane vibrations can freely pass through the apertures. FIG. 3D is again the sketch of the mechanical assembly 250 of an example pico-speaker. The blind 210 is sandwiched between the two insulators 252 and 253 respectively. Structural supports 252 and 253 will typically be of a ring design holding the blind firmly in place but allowing air to flow through the center.

Figure 3E:
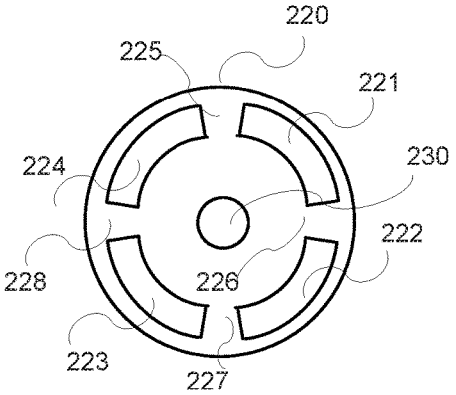
FIG. 3E is an example of the design of a shutter according to an embodiment of the invention.
Figure 3F:
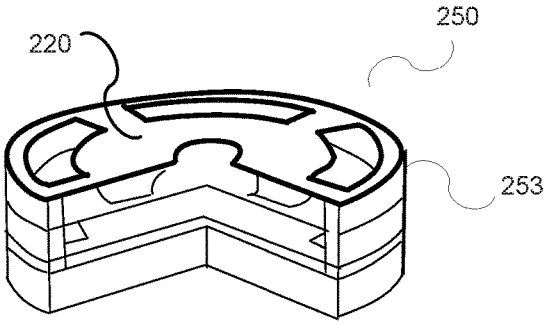
FIG. 3F is a sketch of the mechanical assembly of an example pico-speaker showing the shutter according to an embodiment of the invention.

FIG. 3E is an example of the design of a shutter 220. The shutter 220 is a circular design with four symmetrical apertures 221, 222, 223 and 224 and four corresponding springs 225, 226, 227 and 228, which are at the outer edge and have the purpose of facilitating the vibration of the shutter. There is also a circular aperture 230 at the center of the shutter 220. It can be readily seen that if the shutter 220 is placed on top of the blind 210, then the apertures 211, 212, 213, and 214 of the blind 210 will be shut off. FIG. 3*f* is again the sketch of the mechanical assembly 250 of an example pico-speaker. The shutter 220 is supported by support structure 253.

Figure 4A:
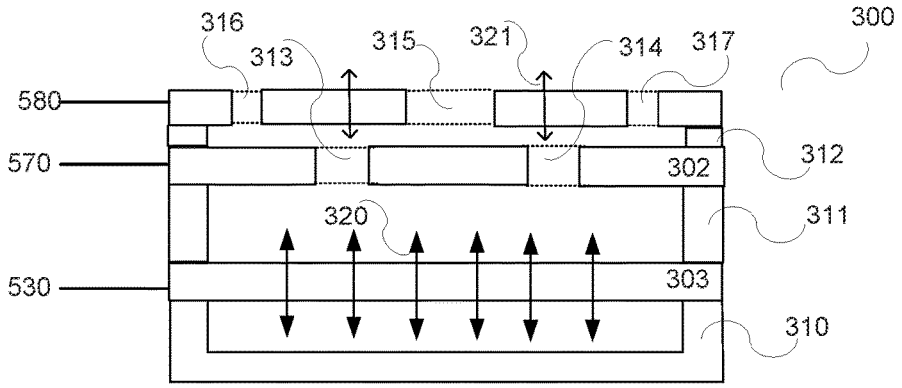
FIG. 4A represents the condition when the shutter is in its neutral position according to an embodiment of the invention.
Figure 4B:
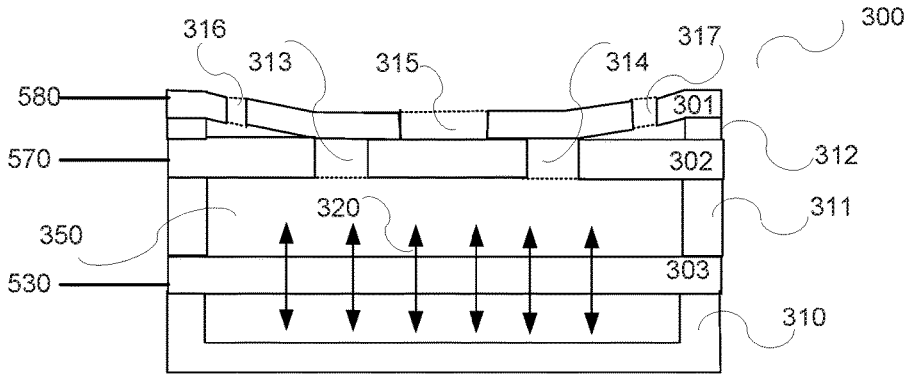
FIG. 4B depicts the state when the shutter is caused to be depressed towards the blind according to an embodiment of the invention.
Figure 4C:
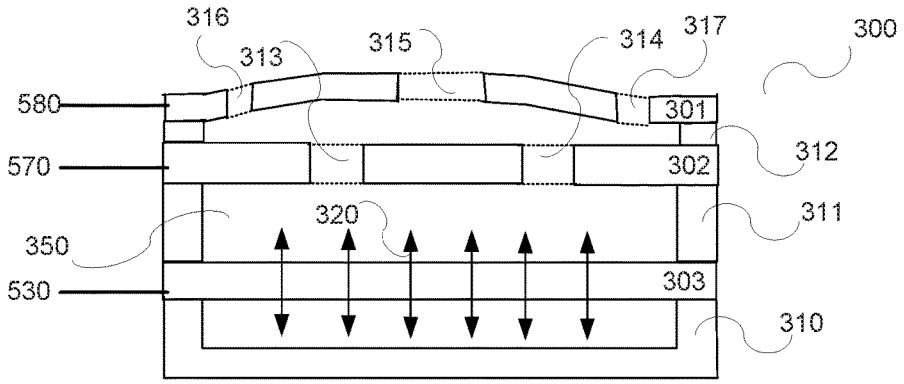
FIG. 4C depicts the state when the shutter is caused to be moved away from the blind according to an embodiment of the invention.

FIGS. 4A-4C are cross sections 300 of the mechanical design of the MEMS pico-speaker that includes a membrane, shutter and blind that are fed by a membrane control signal 530, blind control signal 570 and shutter control signal 580 respectively according to various embodiments of the invention. FIG. 4A represents the condition when the shutter 301 is in its neutral position. The membrane 303 is supported by support structure 310. The membrane is caused to vibrate 320 in the plane perpendicular to its mounting. The blind 302 is supported by structure 311 and the shutter 301 is supported by support structure 312. Note that the apertures 313, 314 in the blind 302 and the apertures 315, 316 and 317 in the shutter 301 are such that they are not aligned with each other. FIG. 4B depicts the state when the shutter 301 is caused to be depressed towards the blind 302. The apertures 313 and 314 in the blind 302 are closed off by the shutter 301. FIG. 4C depicts the state when the shutter 301 is caused to be moved away from the blind 302. The apertures 313 and 314 in the blind 302 are now open and the acoustic wave produced by the vibrating membrane 303 can escape via the apertures 313 and 314 in the blind 302 and the apertures 315, 316 and 317 in the shutter 301.

Note that the apertures 313 and 314 shown in the blind 302 are representative of the four apertures 211, 212, 213, 214 in the blind 210 as shown in FIG. 3C. Similarly, the apertures 316 and 317 shown in the shutter 301 are representative of the four apertures 221, 222, 223 and 224 in the shutter 220 as shown in FIG. 3E.

The acoustic modulator formed by the rigid perforated blind and the shutter cause the ultrasonic vibrations of the membrane to be converted to air waves that are at the required audio signal frequencies. As will be appreciated by one of skill in the art that the actual geometry of the apertures in the membrane, blind and shutter as shown in the figures can be varied and that the figures are for informative purposes only and are not to scale or intended to represent any particular practical design. The advantages of the design concepts as described herein are well documented. It will be pointed out, however, that the basic principle is that by vibrating the membrane at ultrasonic frequencies the resulting air pressure is much higher than could be established by a membrane vibrating at audio frequencies. Note when the shutter closes the apertures in the blind, the sound pressure level (SPL) of the wave generated by the membrane decreases, and when the shutter opens the apertures in the blind, the SPL of the same wave is increased. The action of the shutter and blind in modulating the ultrasonic wave results in the audio-frequency generation that has a flat sound pressure level (SPL) response across a wide audio frequency band.

Figure 5A:
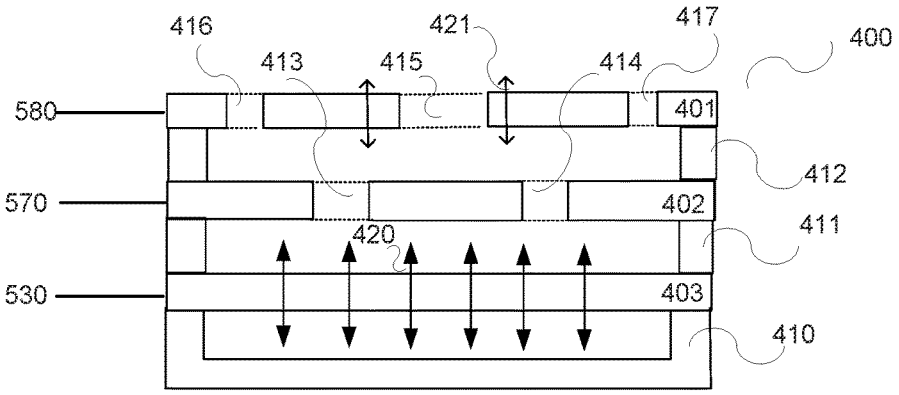
FIG. 5A represents the condition when the shutter and the blind are in their neutral position according to an embodiment of the invention.
Figure 5B:
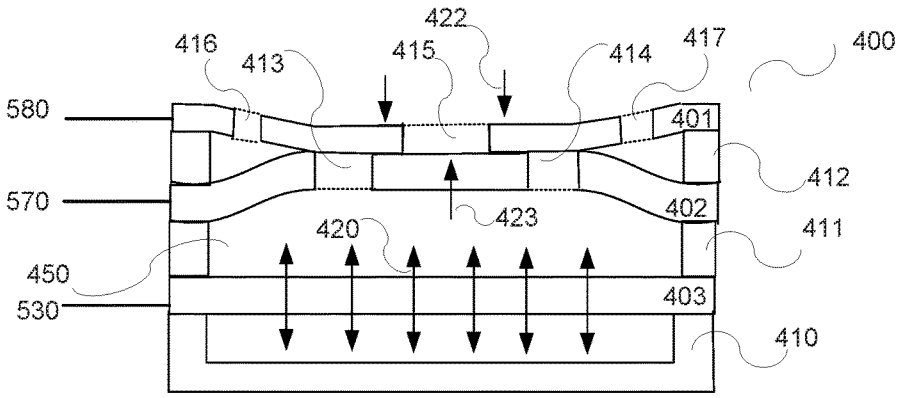
FIG. 5B depicts the state when the shutter and the blind are caused to be depressed towards each other according to an embodiment of the invention.
Figure 5C:
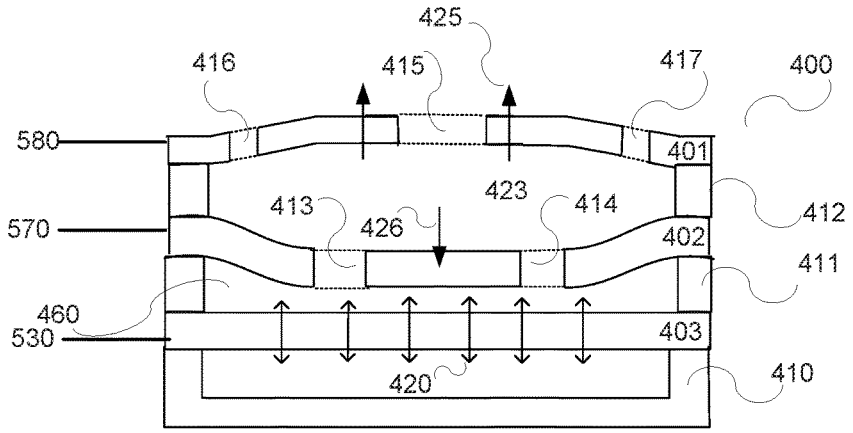
FIG. 5C depicts the state when the shutter and the blind are caused to be moved away from each other according to an embodiment of the invention.

FIGS. 5A-5C are cross sections 400 of the mechanical design of the MEMS pico-speaker according to the embodiment of the invention. FIG. 5A represents the condition when the shutter 401 is in its neutral position. The membrane 403 is supported by support structure 410. As before, the membrane 403 is caused to vibrate 420 in the plane perpendicular to its mounting. The blind 402 is supported by support structure 411 and the shutter 401 is supported by support structure 412. Note again that the apertures 413, 414 in the blind 402 and the apertures 415, 416 and 417 in the shutter 401 are such that they are not aligned with each other. FIG. 5B depicts the state when the shutter 401 is caused to be depressed towards the blind 402. Note, however, that in this disclosure the blind 402 is also flexible and in this condition it is caused to move upwards towards the shutter 401. The apertures 413 and 414 in the blind 402 are closed off by the shutter 401. FIG. 5C depicts the state when the shutter 401 is caused to be moved away from the blind 402. As the blind is now flexible in this condition, it is caused to move away from the shutter 401. The apertures 413 and 414 in the blind 402 are now open and the wave produced by the vibrating membrane 403 can escape via the apertures 413 and 414 in the blind 402 and the apertures 415, 416 and 417 in the shutter 401.

The depth of the modulation of the shutter determines the efficiency of transformation of energy from the ultrasonic wave generated by the membrane to the desired audio frequency wave. The bigger the modulation depth, the more energy will be transferred to audio. This depth of modulation is effectively the difference in attenuation of the ultrasonic wave by the shutter when it is open, as shown in FIG. 4C and FIG. 5C, and when it is closed as shown in FIG. 4B and FIG. 5B. The attenuation is determined by the distance between the blind 402 and the shutter 401. For a given geometry of the shutter, the smaller the distance between the shutter and the blind, the bigger is the attenuation. Thus, the bigger the distance change between the blind and the shutter during the operation of the shutter, the bigger the modulation, and the more efficient is the transfer of energy from ultrasound to audio. The distance between the plates 401 and 402 is determined by the deformation of the plates. In the case of a rigid static blind 302 as shown in FIG. 4, only the shutter 301 is deformed and closing the distance between the plates. In the case where the blind 402 is flexible, as shown in FIGS. 5A-5C, both the blind 402 and the shutter 401 are deformed. Thus, to achieve the same modulation or to produce the same distance between the plates as was produced by the rigid blind, in case of a flexible blind 402, a smaller force is required to be applied to each plate, the blind 401, and the shutter 402. Hence, the result is a significant reduction, in the order of 30% to 40%, in the value of the stimulus signal that needs to be supplied to the pico-speaker modulator. Although the vibration of the shutter and blind are shown as a flexing of the material, the shape of the flexing is shown for example purposes only. The same action could be achieved by a movement up and down of the blind and shutter by vibrating the spacers between them.

There may be different embodiments to implement this scheme of an acoustic modulator using flexible shutter and blind plates. In one embodiment electrostatic actuation may be used. A potential difference at ultrasonic frequency is applied to the flexible blind 401 and flexible shutter 402.

This causes an electrostatic attraction force to operate between the plates, with the result that the two plates will move closer together. An electrical potential difference at ultrasonic frequency may be applied to the rigid blind 301 and flexible shutter 302 but in this case the closing of the distance between the two plates is a result of only the shutter 302 flexing whereas in case where the blind is also flexible, the distance between the two plates is the result of both the blind and the shutter flexing, enabling higher modulation with a lower applied force, and thus smaller actuation voltage.

In another embodiment a piezoelectric actuation scheme may be used. A separate actuation voltage may be applied to each of the two plates, blind and shutter. Similarly to the previous embodiment, the actual actuation voltage required from the combination of a flexible shutter and a flexible blind is reduced relative to the combination of a rigid blind and flexible shutter in order to achieve the same modulation.

Figure 6:
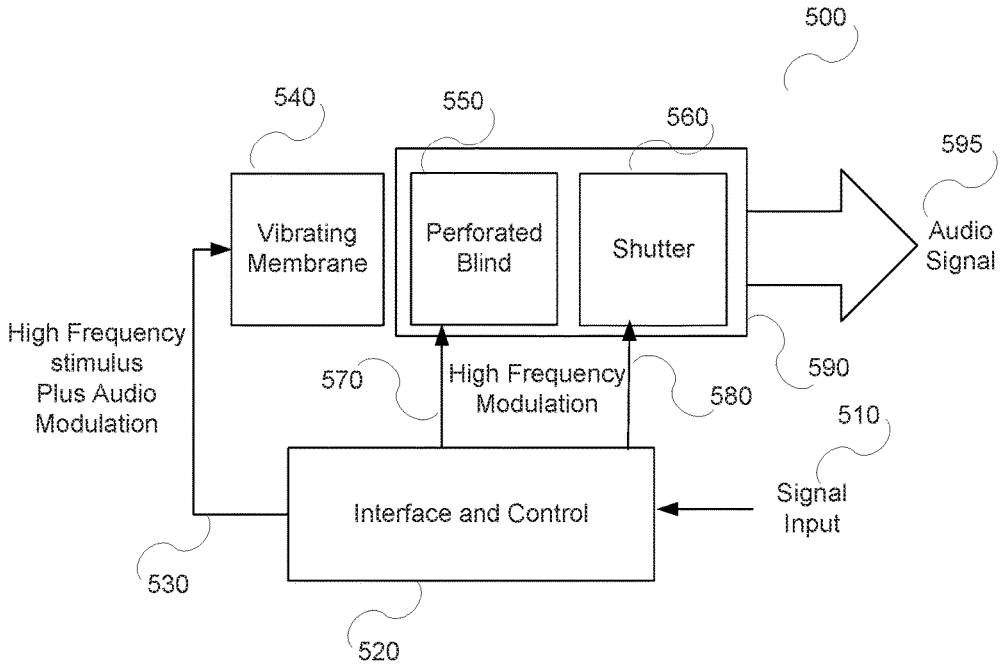
FIG. 6 is a block schematic diagram of an example of a pico-speaker that complies with the disclosure according to an embodiment of the invention.

FIG. 6 is a block schematic diagram of an example of a pico-speaker that complies with the disclosure. The audio signal input 510 is applied to the interface and control block 520. The interface and control block 520 generates three stimulus frequency signals 530, 570 and 580. Stimulus frequency signal 530 is at an ultra sound frequency which is modulated by the audio input signal 510. A typical ultrasound frequency may be in the 100 to 500 KHz range. High Frequency signal 530 is applied to the membrane 540. This causes the membrane to oscillate or vibrate in sympathy with the stimulus frequency 530. The air acoustic wave resulting from the membrane vibrations is modulated by the acoustic modulator block 590 which consists of the blind 550 and the shutter 560. The action of the acoustic modulator 60 is to obstruct and open the air flow from the membrane 540 as previously described in FIGS. 5A-5C. The stimulus signals 570 and 580 may be in the form of a potential difference at ultrasonic frequency, so as to produce an electrostatic effect that causes the blind 550 and shutter 560 to be attracted together. Such electrical potential difference can be implemented by either keeping one of the signals 570, 580 at a fixed potential, for example signal 570 may be connected to ground, while the other is oscillating between the potential of its peer and a certain maximum voltage, for example signal 580 may oscillate between ground and a certain maximum voltage. Alternatively, the same potential difference may be implemented by feeding the two plates with signals that have opposite polarity, thus decreasing the amplitude needed for each signal. It should be noted that the actual waveforms of the signals 570 and 580 supplied to the perforated plate and the shutter may be harmonic, pulses of voltage, charge pulses, or any other periodic stimulus causing periodic potential difference.

In an alternative implementation the shutter and the blind may be actuated by piezoelectric actuation. In such a case the stimuli 570 and 580 applied to the perforated blind and the shutter respectively need to cause their deformation with opposite polarity.

It is important to note that for efficient operation of such flexible plate shutter both plates need to have close resonant frequencies and to be actuated by a stimulus at frequency close to the resonance.

The resulting output from the acoustic modulator 590 is essentially the audio signal 595.

Figure 7:
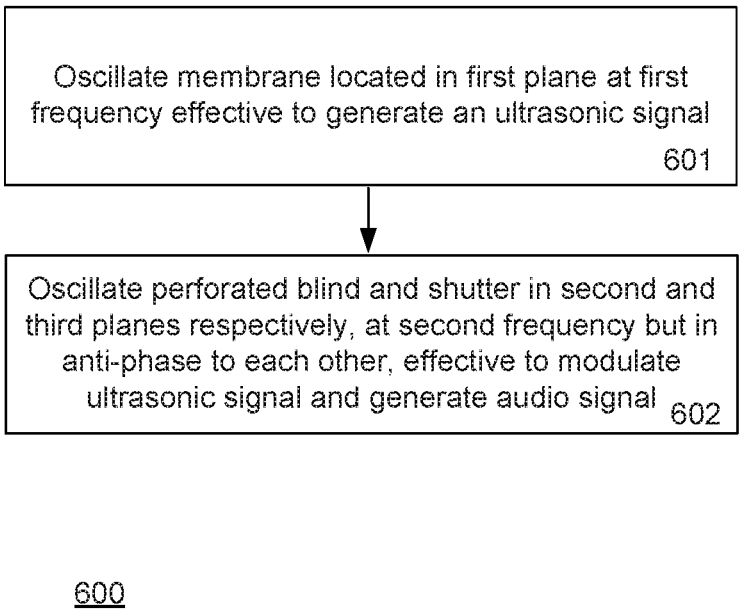
FIG. 7 illustrates a method according to an embodiment of the invention.

FIG. 7 illustrates method 600 according to an embodiment of the disclosure. Method 600 may start by stage 601 where the membrane, which is located in the first plane is caused to vibrate as the first frequency. The first frequency is an ultrasonic signal formed by modulating an ultrasonic frequency with the incoming audio signal. Stage 601 may be followed by stage 602 where the perforated blind and the shutter are caused to oscillate in the second and third planes respectively in anti-phase to each other, such that the ultrasonic vibrations produced by the membrane in stage 601 are modulated to produce the wanted audio signal.

Figure 8:
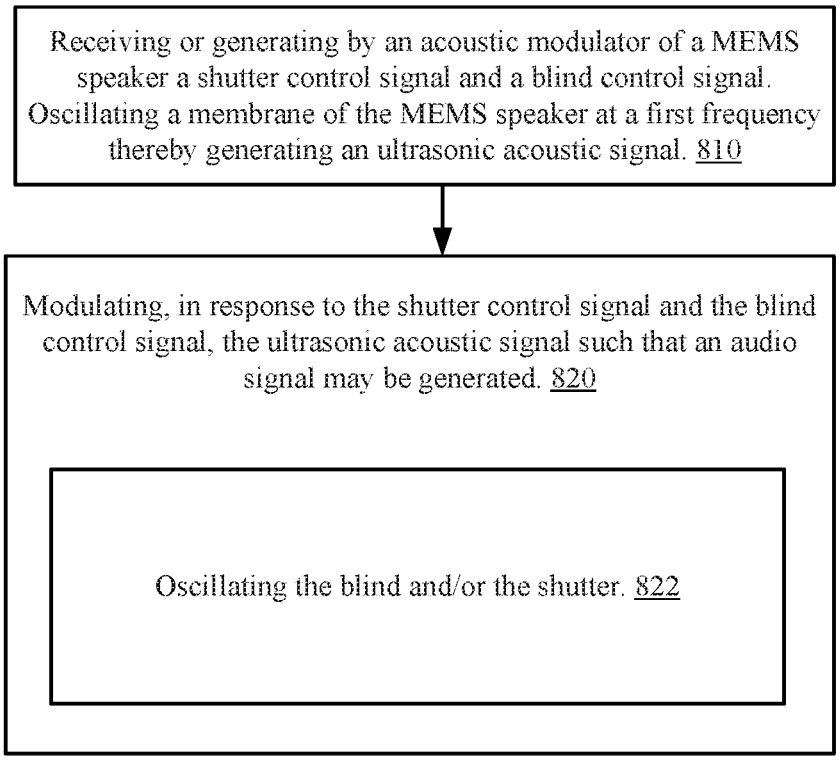
FIG. 8 illustrates a method according to an embodiment of the invention.

FIG. 8 illustrates method 800 according to an embodiment of the invention.

Method 800 may include step 810 of (a) receiving or generating by an acoustic modulator of a MEMS speaker a shutter control signal and a blind control signal and of (b) oscillating a membrane of the MEMS speaker at a first frequency thereby generating an ultrasonic acoustic signal.

The membrane may be positioned in a first plane. The acoustic modulator may include a blind and a shutter. The blind may be positioned in a second plane. The shutter may be positioned in a third plane. The first plane, the second plane and the third plane may be substantially separated from each other.

The acoustic modulator may receive the shutter control signal and/or the blind control signal from a controller. Any hardware controller may be provided. The controller may be an integrated circuit, a part of the integrated circuit, and the like.

Step 810 may include providing the shutter control signal and blind control signal thereby generating an alternating electrostatic force between the shutter and the blind.

Step 810 may include feeding the membrane with a membrane control signal that may be of ultrasonic frequency and may be modulated by an input audio signal.

Additionally or alternatively, step 810 may include receiving of generating the shutter control signal and the blind control signal that are of ultrasonic frequency and may be not modulated by the input audio signal.

Step 810 may be followed by step 820 of modulating, in response to the shutter control signal and the blind control signal, the ultrasonic acoustic signal such that an audio signal may be generated.

The shutter control signal and the blind control signal may be phase shifted in relation to each other.

The shutter control signal and the blind control signal may be in anti-phase.

The blind may be rigid but may receive a dedicated control signal (blind control signal) that may differ or may be independent from the shutter control signal.

The blind may be flexible.

Step 820 may include step 822 of oscillating the blind and/or the shutter.

Step 822 may include oscillating the blind and the shutter or oscillating only the shutter.

Step 822 may include oscillating the blind and the shutter between a first position in which the blind seals shutter openings and between a second position in which the blind does not seal shutter openings.

Step 822 may include oscillating the blind and the shutter between a first position in which the acoustic modulator attenuates the ultrasonic acoustic signal by a first attenuation factor and between a second position in which in which the acoustic modulator attenuates the ultrasonic acoustic signal by a second attenuation factor that differs from the first attenuation factor. The ratio between the first attenuation factor and the second attenuation factor may range between 5 db and 10 db or may have any other value.

Step 822 may include oscillating the blind and the shutter at an oscillating frequency; wherein the oscillating frequency substantially equals a resonant frequency of the shutter and substantially equals a resonant frequency of the blind.

Figure 9:
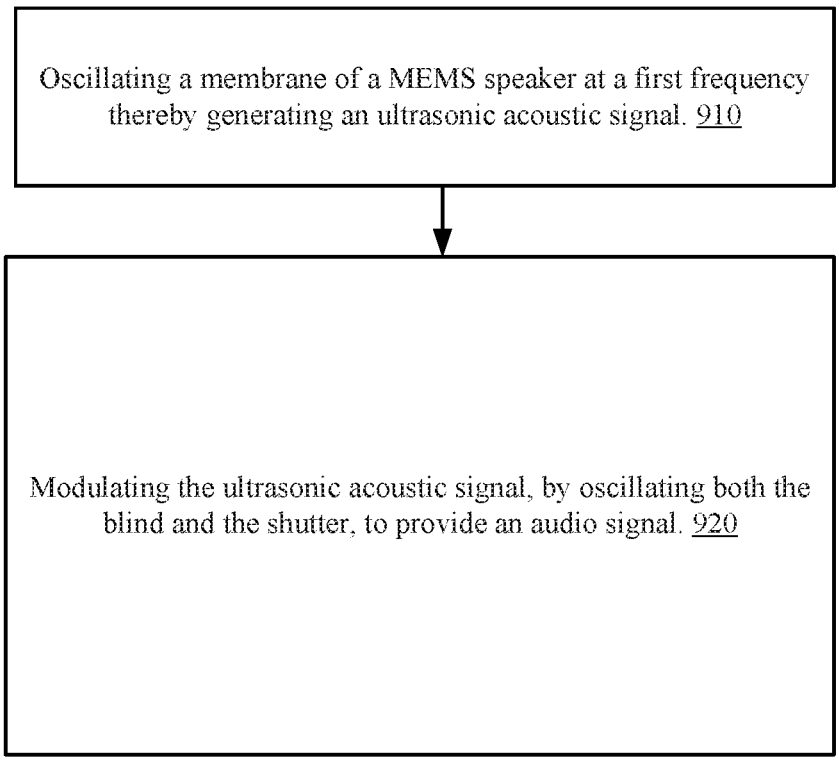
FIG. 9 illustrates a method according to an embodiment of the invention.

FIG. 9 illustrates method 900 according to an embodiment of the invention.

Method 900 may include step 910 of oscillating a membrane of a MEMS speaker at a first frequency thereby generating an ultrasonic acoustic signal. The membrane may be positioned in a first plane. The MEMS speaker may also include an acoustic modulator. The acoustic modulator may include a blind and a shutter. The blind may be positioned in a second plane. The shutter may be positioned in a third plane. The first plane, the second plane and the third plane may be substantially separated from each other.

Step 910 may be followed by step 920 of modulating the ultrasonic acoustic signal, by oscillating both the blind and the shutter, to provide an audio signal.

Step 920 may include applying an alternating electrostatic force between the shutter and the blind.

Step 920 may include applying a piezo-electric actuation on the shutter and the blind.

Figure 10:
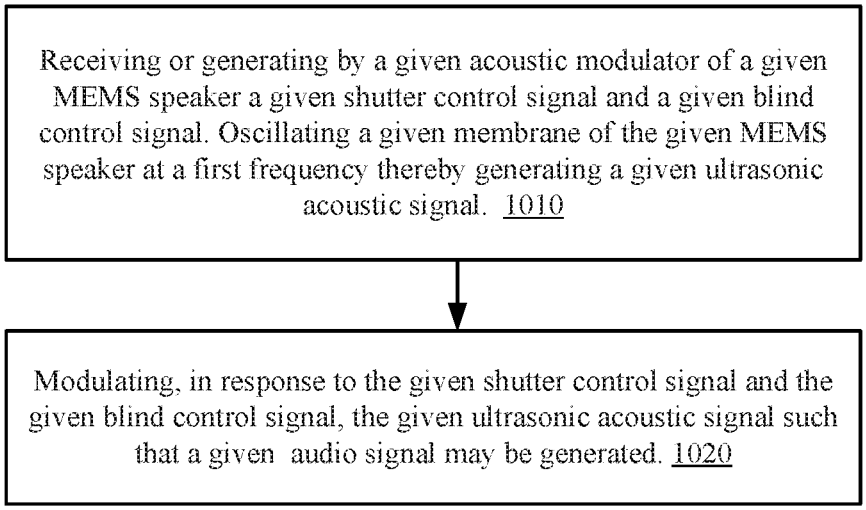
FIG. 10 illustrates a method according to an embodiment of the invention.

FIG. 10 illustrates method 1000 according to an embodiment of the invention.

Method 1000 is applied on one or more MEMS speakers out of multiple MEMS speakers. Method 1000 may include applying any step of method 800 and/or 900 on one or more MEMS speakers of the multiple MEMS speakers.

For example, assuming that method 1000 involves applying steps 810 and 820 of method 800 on one or more MEMS speakers then method 1000 may include executing, on each given MEMS speaker out of one or more MEMS speakers (of the multiple MEMS speakers) steps 1010 and 1020.

Step 1010 may include (a) receiving or generating by a given acoustic modulator of a given MEMS speaker a given shutter control signal and a given blind control signal, and (b) oscillating a given membrane of the given MEMS speaker at a first frequency thereby generating a given ultrasonic acoustic signal.

Step 1020 may include modulating, in response to the given shutter control signal and the given blind control signal, the given ultrasonic acoustic signal such that a given audio signal may be generated.

While the above description contains many specifics, these should not be construed as limitations on the scope, but rather as an exemplification of several embodiments thereof. Many other variants are possible including, for examples: the mechanical designs of the membrane, blind and shutter, the design and layout of the apertures in the membrane, blind and shutter, the materials used, the details of the stimulus signals, the actual vibration characteristics if the membrane, blind and shutter, the method of causing the vibration of the membrane, blind and shutter, the flexing shapes of the membrane blind and shutter. Accordingly the scope should be determined not by the embodiments illustrated, but by the claims and their legal equivalents.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope.

I claim:

1. A micro-electro-mechanical system (MEMS) speaker that comprises:

a membrane positioned in a first plane, wherein the membrane is configured to oscillate at a first frequency thereby generating an ultrasonic acoustic signal; and an acoustic modulator that comprises a blind and a shutter;

wherein the blind is positioned in a second plane; wherein the shutter is positioned in a third plane; wherein the first plane, the second plane and the third plane are substantially separated from each other; and wherein the acoustic modulator is configured to (a) receive or generate a shutter control signal and a blind control signal, and (b) modulate, in response to the shutter control signal and the blind control signal, the ultrasonic acoustic signal such that an audio signal is generated.

2. The MEMS speaker according to claim 1 wherein the shutter control signal and the blind control signal are phase shifted in relation to each other.

3. The MEMS speaker according to claim 1 wherein the shutter control signal and the blind control signal are in anti-phase.

4. The MEMS speaker according to claim 1 wherein the blind is rigid.

5. The MEMS speaker according to claim 1 wherein the blind is flexible.

6. The MEMS speaker according to claim 5 wherein the blind and the shutter are configured to oscillate between a first position in which the blind seals shutter openings and between a second position in which the blind does not seal shutter openings.

7. The MEMS speaker according to claim 5 wherein the blind and the shutter are configured to oscillate between a first position in which the acoustic modulator attenuates the ultrasonic acoustic signal by a first attenuation factor and between a second position in which in which the acoustic modulator attenuates the ultrasonic acoustic signal by a second attenuation factor that differs from the first attenuation factor.

8. The MEMS speaker according to claim 7 wherein a ratio between the first attenuation factor and the second attenuation factor ranges between 5 db and 10 db.

9. The MEMS speaker according to claim 5 wherein the shutter and the blind are configured to oscillate at an oscillating frequency; wherein the oscillating frequency substantially equals a resonant frequency of the shutter and substantially equals a resonant frequency of the blind.

10. The MEMS speaker according to claim 1 wherein when the MEMS speaker is idle then vertical projections of shutter openings on the blind are located at locations that differ from locations of blind openings.

11. The MEMS speaker according to claim 1 wherein the shutter control signal and blind control signal once provided to the shutter and the blind generate an alternating electrostatic force between the shutter and the blind.

12. The MEMS speaker according to claim 1 wherein each one of the shutter and the blind comprises a piezoelectric layer that is positioned between a pair of electrodes.

13. The MEMS speaker according to claim 1, wherein the membrane is fed with a membrane control signal that is of ultrasonic frequency and is modulated by an input audio signal; wherein the shutter control signal and the blind control signal are of ultrasonic frequency and have values that are indifferent to the input audio signal.

14. A device comprising multiple micro-electro-mechanical system (MEMS) speakers;

wherein each MEMS speaker comprises a membrane, a blind and a shutter;

wherein multiple membranes of the multiple MEMS speakers are positioned in a first layer;

wherein multiple blinds of the multiple MEMS speakers are positioned in a second layer;

wherein multiple shutters of the multiple MEMS speakers are positioned in a third layer;

wherein the first plane, the second plane and the third plane are substantially separated from each other;

wherein a given MEMS speaker of the multiple speakers comprises a given membrane that is configured to oscillate at a first frequency thereby generating a given ultrasonic acoustic signal; a given blind and a given shutter of the given MEMS speaker form a given acoustic modulator that is configured to (a) receive or generate a given shutter control signal and a given blind control signal, and (b) modulate, in response to the given shutter control signal and the given blind control signal, the given ultrasonic acoustic signal such that a given audio signal is generated.

15. A micro-electro-mechanical system (MEMS) speaker that comprises:

a membrane positioned in a first plane, wherein the membrane is configured to oscillate at a first frequency thereby generating an ultrasonic acoustic signal; and an acoustic modulator that comprises a blind and a shutter; wherein the blind is flexible and is positioned in a second plane; wherein the shutter is positioned in a third plane; wherein the first plane, the second plane and the third plane are substantially separated from each other;

wherein the acoustic modulator is configured to modulate the ultrasonic acoustic signal, by oscillating both the blind and the shutter, to provide an audio signal.

16. The MEMS speaker according to claim 15 wherein the acoustic modulator is configured to applying an alternating electrostatic force between the shutter and the blind.

17. The MEMS speaker according to claim 15 wherein the acoustic modulator is configured apply a piezo-electric actuation on the shutter and the blind.

18. The MEMS speaker according to claim 15 wherein the blind and the shutter are configured to oscillate between a first position in which the blind seals shutter openings and between a second position in which the blind does not seal shutter openings.

19. The MEMS speaker according to claim 15 wherein the blind and the shutter are configured to oscillate between a first position in which the acoustic modulator attenuates the ultrasonic acoustic signal by a first attenuation factor and between a second position in which in which the acoustic modulator attenuates the ultrasonic acoustic signal by a second attenuation factor that differs from the first attenuation factor.

20. The MEMS speaker according to claim 19 wherein a ratio between the first attenuation factor and the second attenuation factor ranges between 5 db and 10 db.

21. The MEMS speaker according to claim 15 wherein the shutter and the blind are configured to oscillate at an oscillating frequency; wherein the oscillating frequency substantially equals a resonant frequency of the shutter and substantially equals a resonant frequency of the blind.

22. A device comprising multiple micro-electro-mechanical system (MEMS) speakers;

wherein each MEMS speaker comprises a membrane, a blind and a shutter;

wherein multiple membranes of the multiple MEMS speakers are positioned in a first layer;

wherein multiple blinds of the multiple MEMS speakers are positioned in a second layer;

wherein multiple shutters of the multiple MEMS speakers are positioned in a third layer;

wherein the first plane, the second plane and the third plane are substantially separated from each other;

wherein a given MEMS speaker of the multiple speakers comprises a given membrane, a given blind that is flexible and a give shutter; wherein the given membrane is configured to oscillate at a first frequency thereby generating an ultrasonic acoustic signal; and wherein a given acoustic modulator that comprises the given blind and the given shutter is configured to modulate the ultrasonic acoustic signal, by oscillating both the given blind and the given shutter, to provide an audio signal.

* * * * *